US007160235B2

(12) United States Patent
McNally et al.

(10) Patent No.: US 7,160,235 B2
(45) Date of Patent: Jan. 9, 2007

(54) PASSIVE EXERCISE APPARATUS

(76) Inventors: Lynda Jeanne McNally, 358 Commonwealth Ave., B3, Boston, MA (US) 02115; Cynthia Nuzzi Prunty, 65 E. India Row, Boston, MA (US) 02110

( * ) Notice: Subject to any disclaimer, the term of this patent is extended or adjusted under 35 U.S.C. 154(b) by 272 days.

(21) Appl. No.: 10/199,742

(22) Filed: Jul. 20, 2002

(65) Prior Publication Data

US 2004/0015108 A1 Jan. 22, 2004

Related U.S. Application Data

(60) Provisional application No. 60/306,786, filed on Jul. 20, 2001.

(51) Int. Cl.
*A63B 26/00* (2006.01)

(52) U.S. Cl. ..... 482/142; 482/148

(58) Field of Classification Search ..... 482/142, 482/140, 148; D21/676–686, 690
See application file for complete search history.

(56) References Cited

U.S. PATENT DOCUMENTS 3,781,931 A 1/1974 Knickerbocker
4,241,949 A 12/1980 Parker
5,033,742 A 7/1991 Johnson et al.
5,556,363 A 9/1996 Hutchins
5,643,165 A 7/1997 Klekamp
5,848,450 A * 12/1998 Oexman et al. ..... 5/713
5,887,944 A 3/1999 Boost
5,951,403 A 9/1999 Trzos
2003/0028971 A1* 2/2003 Chaffee ..... 5/706

* cited by examiner

*Primary Examiner*—Lori Amerson
(74) *Attorney, Agent, or Firm*—Fish & Richardson P.C.

(57) ABSTRACT

A passive exercise apparatus for use in an erect, non-recumbent seating position that provides an unstable platform capable of encouraging an omni-directional involuntary rocking motion that will result in the involuntary contractions of muscles involved in maintaining muscle tone and promoting proper posture (viz., the gluteus maximus, gluteus medius, and gluteus minimus muscles, external oblique muscles, and other muscles in the abdominal, lumbar/sacral, and pelvic regions) in order to counterbalance the rocking forces. The purpose of the device is to provide continuing involuntary contractions of these muscle groups (a recognized form of EXERSITTING, which is the combined execution of concentric and isometric muscle exertion and contractions performed while sitting on the apparatus of the present invention in order to help maintain muscle tone and encourage good seated posture.

46 Claims, 6 Drawing Sheets

PASSIVE EXERCISE APPARATUS

CROSS-REFERENCE TO RELATED APPLICATION

This application claims priority to U.S. Provisional Patent Application No. 60/306,786, filed Jul. 20, 2001.

FIELD OF THE INVENTION

The present invention relates to a passive exercise apparatus that assists the user to maintain muscle tone in selected muscle groups and to encourage good seated posture.

BACKGROUND OF THE INVENTION

Many millions of people have adopted a fitness lifestyle. They routinely participate in various exercise activities, such as weight training and aerobics. These individuals use exercise equipment at fitness clubs, gyms, and at home. In addition to the significant amount of time, membership dues, and energy expended to get into and stay in shape, these individuals are increasingly purchasing exercise devices to use at home and in the office.

Considered one of the most difficult body parts to discipline, the buttocks (viz., gluteus maximus, gluteus medius, and gluteus minimus muscles) are the focus of tremendous strategic muscle conditioning routines. However, the benefits of such exercise are often negated by the demands of modem living, i.e., sitting for extended periods of time, either at a desk—be it for business or personal demands—, while driving, flying, or commuting via public/commercial transportation where one is subjected to prolonged sitting. In addition, such prolonged seating is not conducive to promoting good seated posture. It is important to stress these two inescapable problems brought on by excessive sitting: 1) undoing much of the benefit obtained by targeting gluteal exercise and 2) potentially compromising one's health.

What is needed is a passive exercise apparatus that is easy to use and that promotes both involuntary and conscious muscular contraction of the buttocks and area muscles, and (as a bonus) assists with achieving good seating posture. The ideal apparatus would be incorporated into the construction of a chair, bench, or other seating fixtures, equipment, or furnishings, and/or would also be portable and suited for use at home, in the office, while traveling, or in any environment in which one is required sit for a prolonged period of time.

SUMMARY OF THE INVENTION

Accordingly, it is an object of the present invention to provide a passive exercise apparatus that is discrete and easy to use, and that promotes muscular contraction of the buttocks and area muscles, and good seated posture.

It is another object of the present invention to provide a passive exercise apparatus that may be used to maintain muscular toning in the buttocks region and area muscles, in conjunction with an exercise program.

It is an additional object of the present invention to provide a passive exercise apparatus that is acceptable for daily use, durable, and easy to clean.

It is a further object of the present invention to provide a passive exercise apparatus that is suitable for use on any surface generally considered to be a seating surface.

It is yet another object of the present invention to provide a passive exercise apparatus that is incorporated into the construction of a chair, bench, or other seating fixtures, equipment, or furnishings.

It is yet an additional object of the present invention to provide a passive exercise apparatus wherein the amount of exercise can be controlled by the user by adjustment to the apparatus.

It is a still further object of the present invention to provide a passive exercise apparatus that is portable and suited for use at home, in the office, and while travelling, or in any environment in which one is required to sit for a prolonged period of time.

The present invention relates to a passive exercise apparatus for use in an erect, non-recumbent seated position. The apparatus of the present invention provide an unstable seating platform capable of encouraging an omni-directional rocking motion that will result in the involuntary and conscious contraction of muscles involved in maintaining proper posture (viz., the gluteus maximus, gluteus medius gluteus minimus, external oblique muscles, and other muscles in the abdominal, lumbar/sacral, and pelvic regions). The purpose of the apparatus is to provide continuing involuntary and conscious contraction of these muscle groups (a recognized form of EXERSITTING,™ which is the combined execution of concentric and isometric muscle exertion and contractions performed while sitting on the apparatus of the present invention) in order to maintain muscle tone and additionally, to encourage good seated posture.

It is contemplated that the apparatus may be sized to suit a wide variety of body types. The outer surface of the apparatus may be of a durable, flexible material designed for comfort, ease of cleaning, and function. One design option is a fabric covering which is removable, washable, and comfortable. The outer surface may further be textured, either as a continuous feature or as discrete features.

It is further contemplated that the apparatus may be incorporated into the construction of a chair, bench, or other seating fixtures, equipment, or furnishings.

Other objects, features and advantages will be apparent from the drawings in which:

DETAILED DESCRIPTION OF THE INVENTION

Figure 1:
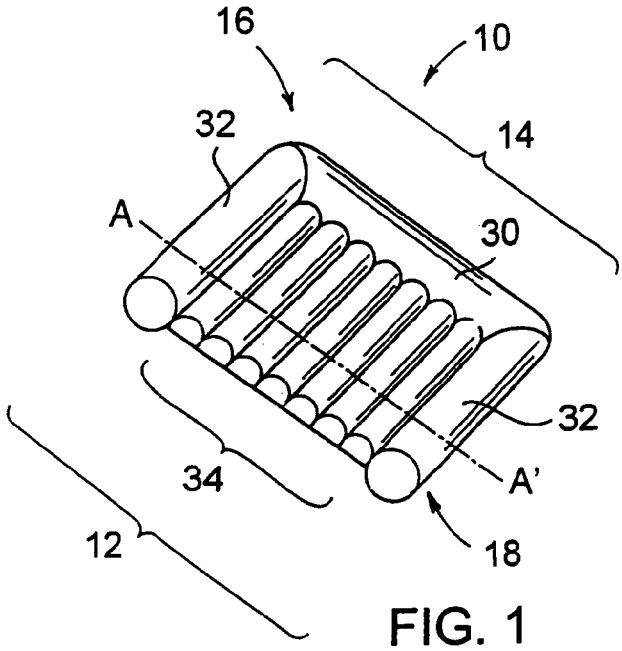
FIG. 1 shows a perspective view of one embodiment of the exercise apparatus of the present invention.
Figure 2A:
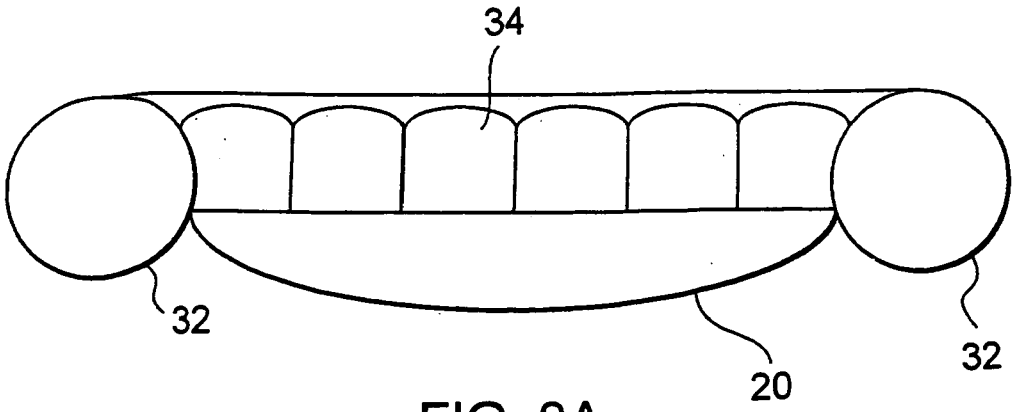
FIGS. 2A show axial cross-sections of the embodiment of FIG. 1 taken through the line A–A' together with various embodiments of movement means of the present invention.
Figure 2B:
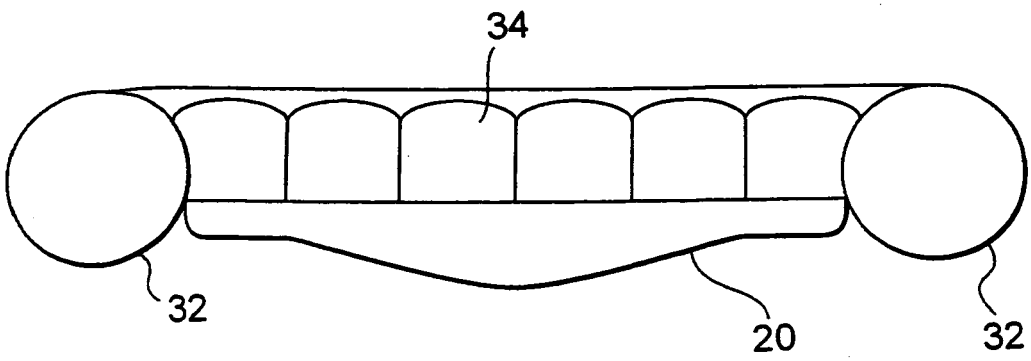
Figure 2C:
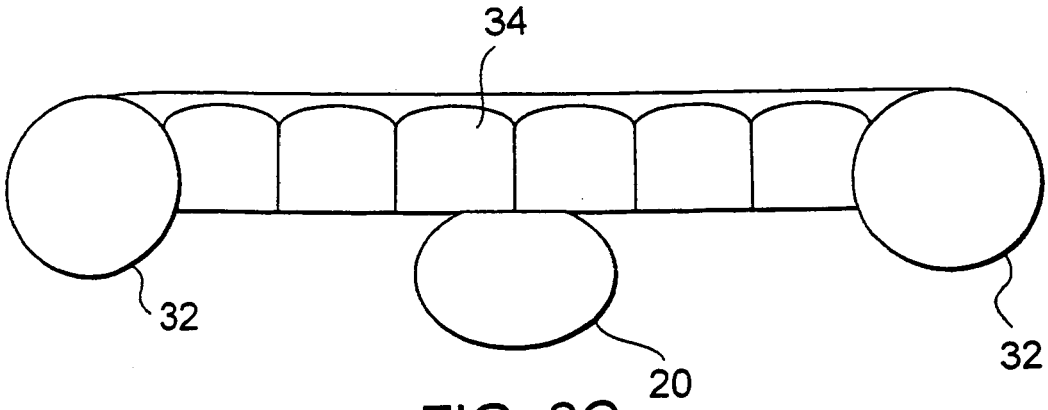
Figure 3:
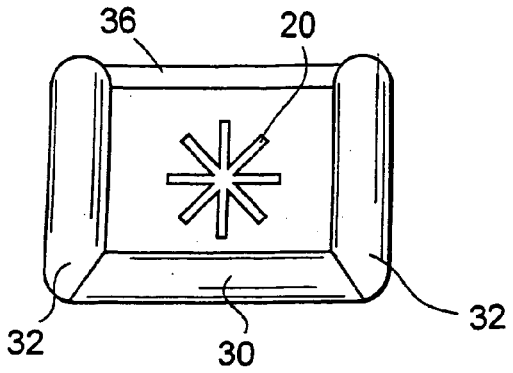
FIG. 3 shows an inverted plan view of a variation of the embodiment of FIG. 1.

In a preferred embodiment, shown in FIGS. 1 to 3, the apparatus of the present invention comprises a seating element 10 having a forward end 12 and a rearward end 14, an upper surface 16 that makes direct contact with the buttocks and that is capable of supporting a human being and a lower surface 18 that may make contact with the seating surface (i.e., the surface on which seating element 10 rests). Seating element 10 further comprises lumbar support channel 30 and lateral support channels 32 arranged to form a U-shape, "S" serpentine, half-circle, or an anatomically designed seat shape. It is contemplated that lumbar support channel 30 and lateral support channels 32 may either be separate elements or may be in fluid communication with each other. Lumbar support channel 30 and lateral support channels 32 provide form to seating element 10 and also may act as "bumpers" to prevent over-motion during use.

Seating element 10 still further comprises a plurality of inner channels 34 disposed in parallel fashion to lateral support channels 32, such that the first end of inner channels 34 define forward end 12 of seating element 10 and the second end of inner channels 34 are attached to lumbar support channel 30, or they will be seamed together to move in unison. Inner channels 34 provide a comfortable seating surface while acting as individual spring elements that react to the weight of the seated user. It is contemplated that inner channels 34 may be free to move independently of each other by means of attachment to adjacent channels (either lateral support channels 32 or inner channels 34) only along forward end 12 (all inner channels 34 being attached to lumbar support channel 30). It is further contemplated that forward attachment means 36 optionally may be disposed along forward end 12 in parallel to lumbar support channel 30. Forward attachment means 36 may be a separate channel or may be of a solid, yet flexible, material that will not interfere with the proper operation of seating element 10. It is contemplated that, where forward attachment means 36 is provided, inner channels 34 may be attached solely to lumbar support channel 30 and forward attachment means 36, and not to each other along their length.

Seating element 10 is acceptable for daily use, durable, and easy to clean. Seating element 10 additionally may be provided with special features, such as felt pads 42 and rounded corners 44, to prevent damage to seating surfaces by use of seating element 10, and may contain additional features, such as rubber contact feet 46 or a design texture 48, to prevent slipping or sliding of base support element 40 on the seating surface.

The apparatus of the present invention achieves the objects thereof by encouraging omni-directional motion of a seated user in direct response to the user's weight acting on each of the individual components of seating element 10. Because each of the components is capable of at least some independent movement relative to each of the other components, seating element 10 is inherently unstable, causing the user to alternately contract and relax certain muscle groups in order to maintain an erect seated posture. This constant rebalancing by the user results in the desired passive exercise.

Figure 4A:
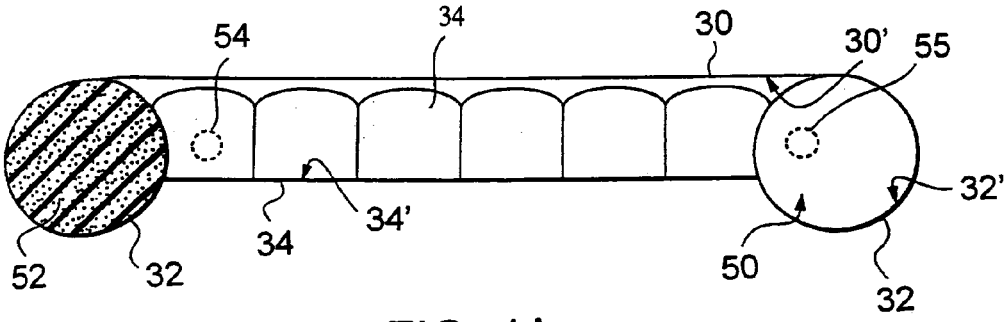
FIGS. 4A–C show various views presenting different inflation means for the embodiment of FIG. 1.
Figure 4B:
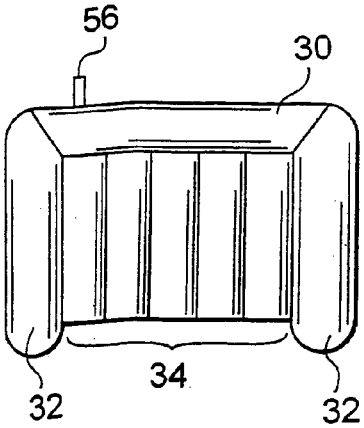
Figure 4C:
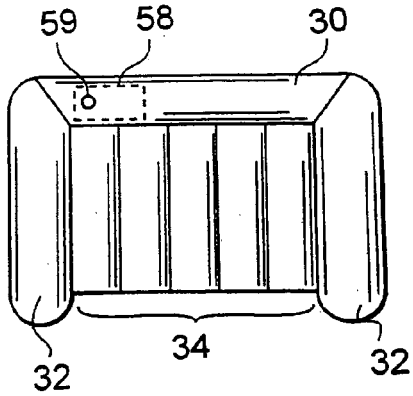

It is desired that inner channels 34 be filled with a compressible or resilient material 50, or combination of such materials. Material 50 may include air, gels, and foam of various densities. Alternatively, inner channels 34 may be provided with a combination of these materials, e.g., both air and high-density foam. Where material 50 is a gel, foam, or combination gel/foam, the user cannot modify the gel or foam content in order to change the level of exercise desired, as can be done if material 50 is air.

Where material 50 includes air, there are several possible inflation options. The first such option, shown in FIG. 4A, is a foam assist, i.e., using a high density, compact cell foam 52, which provides a resistive force against the inner walls 30', 32', and 34' of lumbar support channel 30, lateral support channels 32, and/or inner channels 34, respectively, thus forming a reduced pressure gradient and drawing in air from the outside environment through at least one one-way valve 54. This option requires that lumbar support channel 30, lateral support channels 32, and inner channels 34 be in fluid communication. Additionally, a release valve 55 may be provided to deflate seating element 10, either in order to flatten it for storage or to reduce its resilience to seating force. The second such option, shown in FIG. 4B, is use of a pressure-activated valve 56 that opens and allows for air inflation in response to exogenous air pressure, introduced either by means or the user's mouth or an air compressor or pump. Valve 56 may likewise be used to deflate seating element 10. The third such option, shown in FIG. 4C, is an integral pump means 58 that may draw air into seating element 10 by means of valve 59, which may also be used to deflate seating element 10. Pump means 58 may be powered either by the external application of force, such as a hand or foot, or by means of an electric pump or fan, driven either by AC or DC current. It is contemplated that pressure-activated valve 56 or integral pump means 58 may be disposed within lumbar support channel 30 and that lateral support channels 32 and inner channels 34 are in fluid communication therewith without affecting performance of seating element 10.

Lower surface 16 may optionally interface with movement means 20 capable of encouraging omni-directional movement of element 10, such that when a human being is seated on upper surface 16 of seating element 10, movement means 20 causes seating element 10 to move such that the user is forced to perform the EXERSITTING™ function of the concentric and isometric muscular contraction of the buttock and area muscles to overcome the forces operating in the direction of the movement and restore the human being to an erect, stable seating position.

As shown in FIGS. 2A–C, it is contemplated that movement means 20 has a geometry that may be hemispherical, modified frustoconical, or cylindrical. As shown in FIG. 3, movement means 20 may also comprise a collection of planar fins, each having a semi-circular shape, arrayed such that they function together as a hemisphere. However, any geometry that results in the instability of seating element 10 is desirable. It is further contemplated that movement means 20 may be of a spongy or elastic texture or have a substance with a spongy or elastic texture applied to the outer surface thereof, such that wooden or other hard furniture or surfaces on which element 10 is used are not damaged. Examples of such spongy or elastic-textured materials include foams, air sacs, gel sacs, water sacs, coils, and other resilient materials.

Figure 11:
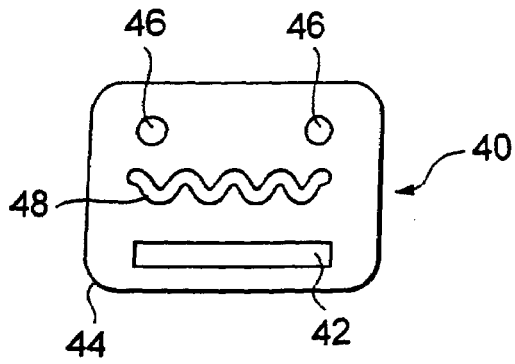
FIG. 11 shows an inverted plan view of the variation shown in FIG. 10.
Figure 10:
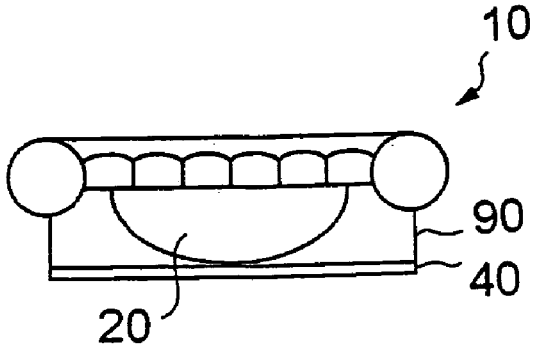
FIG. 10 shows a plan view of a variation of the embodiment of FIG. 5.

In a second embodiment, shown in FIGS. 10 and 11, seating element 10 does not contact the seating surface directly, but, rather, is attached to or disposed above or within base support element 40, which in turn makes direct contact with the seating surface. The primary function of base support element 40 is to promote additional voluntary and conscious muscular contraction of the buttocks as seating element 10 rocks or rotates in response to sitting pressure. Base support element 40 is acceptable for daily use, durable, and easy to clean. Base support element 40 additionally may be provided with special features, such as felt pads 42 and rounded corners 44, to prevent damage to seating surfaces by use of seating element 10, and may contain additional features, such as rubber contact feet 46 or a design texture 48, to prevent slipping or sliding of base support element 40 on the seating surface.

Base support element 40 may be a one-piece component or multiple-component assembly, in accordance with design requirements such as cost, size limits, and type of intended seating surface. It is further contemplated that base support element 40 may be incorporated into the construction of a chair, bench, or other seating fixtures, equipment, or furnishings.

In this embodiment, base support element 40 provides a rigid, planar surface in contact with movement means 20, such that the desired omni-directional rocking motion results, even when seating element 10 is used when the seating surface is soft (i.e., one that will readily deform when sitting pressure is applied), such as on a soft chair, sofa, or car seat. Without the use of base support element 40 on soft seating surfaces, the micro-movement of the components of seating element 10 is limited, as these components tend to settle into the seating surface rather than experience a resistive force that, in turn, causes the omni-directional rocking motion that results in the desired passive exercise. Moreover, because the surface of base support element 40 that contacts movement means 20 is planar, base support element 40 actually enhances the motion of seating element 10, particularly when movement means 20 has a hemispherical, functional hemispherical, or cylindrical geometry. Accordingly, it is further contemplated that seating element 10 may be used in conjunction with base support element 40 even on a hard surface (i.e., one that will not readily deform when sitting pressure is applied) when a higher level of exercise is desired.

Figure 5:
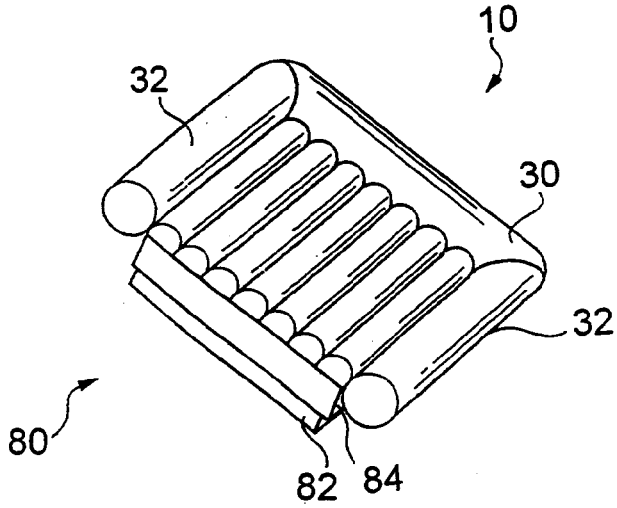
FIG. 5 shows a perspective view of a second embodiment of the exercise apparatus of the present invention.
Figure 6A:
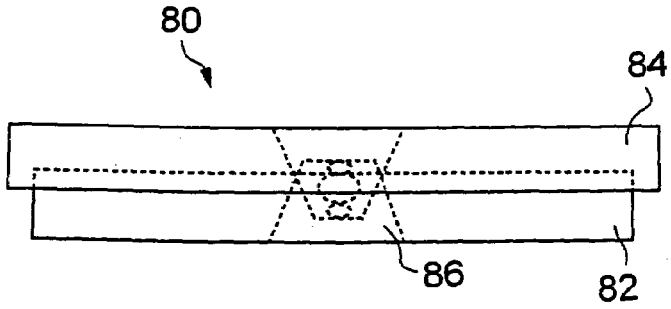
FIGS. 6A–B show front elevations of the base support element of the embodiment of FIG. 4 in different states of use.
Figure 6B:
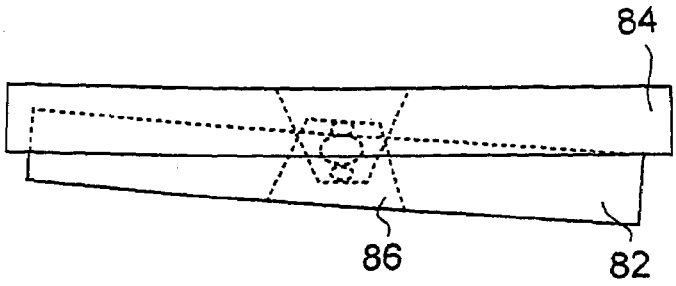

As shown in FIGS. 5–6, base support element 80 is a variation of base support element 40. While base support element 40 is typically used in conjunction with seating element 10, base support element 80 may also be used separately. Base support element 80 may comprise a lower base member 82, an upper base member 84 and flexible biasing means 86 therebetween. It is further contemplated that biasing means 86 also serves to attach upper base member 84 to lower base member 82. Other arrangements are contemplated, such as where lower base member 82 is disposed partly within upper base member 84 such that only a predefined travel distance of each member relative to the other is possible.

Where base support element 40 is attached to seating element 10, it is necessary that means of attachment 90 disposed between base support element 40 and seating element 10 has sufficient elasticity and/or travel as to enable seating element 10 to rock omni-directionally while base support element 40 remains essentially stationary. Further, by making means of attachment 90 releasable, such that seating element 10 may be detached from base support element 40, seating element 10 alone may be used if the seating surface is hard, or if a lesser amount of exercise is desired on a soft surface. Likewise, where base support element 80 is employed, release of means of attachment 90 enables base support element 80 to be used apart from seating element 10.

Where use with base support element 40 is contemplated, seating element 10 has attachment means 31 disposed about the periphery of lateral support elements 32, and, optionally, lumbar support element 30, to securely fasten seating element 10 to base support element 40 during use. Base support element 40 likewise may be provided with corresponding attachment means. Attachment means 31 (and, optionally 41) include Velcro, snaps, straps, clips, slides, fabric or plastic ties, or magnets. Alternatively, base support element 40 may be inserted into a fabric pouch 72 incorporated into an optional fabric covering 70 for seating element 10.

Figure 7:
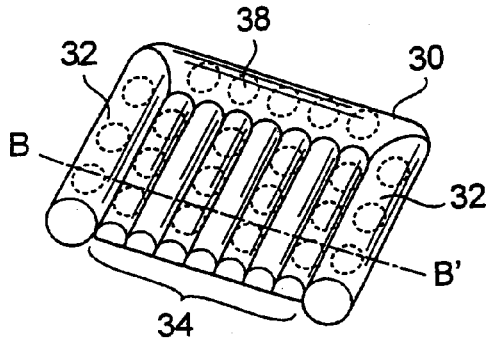
FIG. 7 shows a perspective view of a third embodiment of the exercise apparatus of the present invention.
Figure 8:
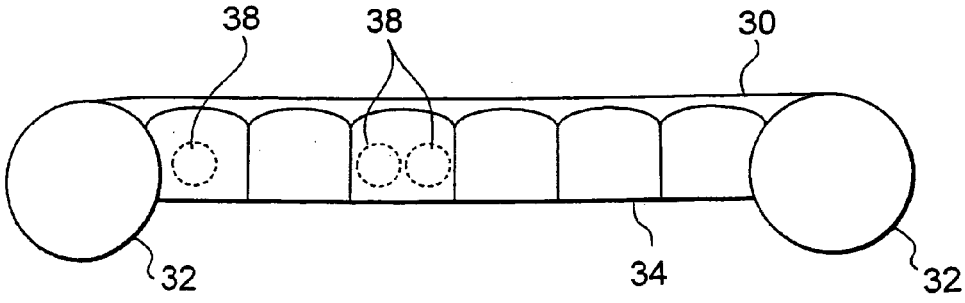
FIG. 8 shows an axial cross-section of the embodiment of FIG. 6 taken through the line B–B'.

In the third embodiment, shown in FIGS. 7 and 8, lumbar support channel 30, lateral support channels 32, and/or inner channels 34 may further contain motion drivers 38 to promote additional relative movement of the components of seating element 10, resulting in enhanced instability of the device. Motion drivers 38 may be disposed in all channels, in lateral support channels 32 only, in inner channels 34 only, or in alternate inner channels 34, either alone or in combination with lumbar support channel 30 and/or lateral support channels 32.

Motion drivers 38 are solid, discrete roller elements that move within the channels when sitting pressure is applied to the upper, outer surface of the channel. The solid motion drivers 38 act to promote additional user movement by providing a resisting pressure to the channel walls. This resisting pressure may promote additional relative movement of inner channels 34 or, by transmission through the cell walls to the user, may promote additional reactive and repositioning movement of the user. Motion drivers 38 may have one of several geometries, including spherical, ellipsoid, cylindrical, or geodesic (with sufficiently rounded corners to ensure comfort and unrestricted movement with applied sitting pressure).

The motion drivers may additionally have surface features to enhance their function, including dimples, grooves, or radial projections, such as knobs, ridges, cones, or other geometries, or a combination thereof, all with sufficiently rounded ends in order to further stimulate driving motion. Motion drivers 38 having varying geometries may be used within one channel, e.g., alternating spherical and cylindrical motion drivers 38 or motion drivers 38 having the same geometry but having different diameters. The extent to which motion drivers 38 promote additional movement may be controlled by the volume of material 50 used to fill the channels in which they are disposed. If material 50 is air, the volume of air may be varied by using an air moving device, such as pump or fan, to fill the inflatable inner and outer channels or by releasing contained air through a relief valve. Material 50 may also be in the form of dense sponge, pre-filled liquid foam, or the user may be instructed to manually add a measure of water.

Figure 9:
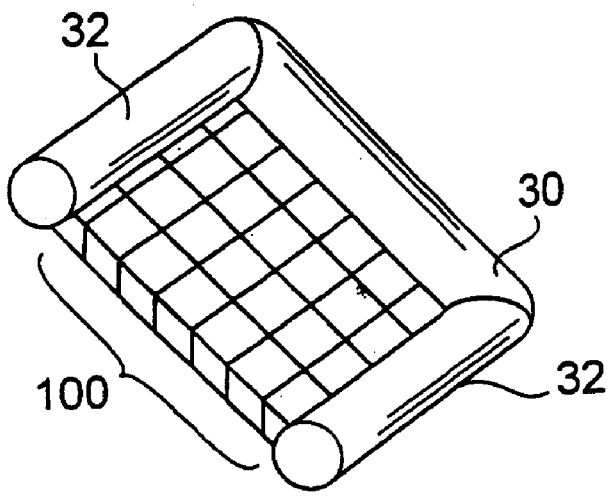
FIG. 9 shows a perspective view of a fourth embodiment of the exercise apparatus of the present invention.

In a fourth embodiment, shown in FIG. 9, seating element 10 comprises in place of inner channels 34 a plurality of individual chambers 100, which are attached to each other and to lumbar support channel 30 and, optionally, to lateral support channels 32. It is contemplated that individual chambers are all seamed and capture pockets of air, and are either free to move in relation to each other or do not move independently, but rather as "one," albeit individualized unit. It is contemplated that each of individual chambers 100 is capable of having disposed therewithin motion drivers 38, as above. A contemplated variation of this embodiment is to have a weave of tubing that may only be air-filled or have a combination of fill material 50, e.g., tubes running N to S would contain air, while tubes running E to W would contain foam, sponge, or water. It is further contemplated that certain of individual chambers 100 could be larger in size than others. Where these larger individual chambers 100 contain one or more motion driver 38, the motion driver(s) would have a larger free-floating area.

It will now be apparent to those skilled in the art that other embodiments, improvements, details, and uses can be made consistent with the letter and spirit of the foregoing disclosure and within the scope of this patent, construed in accordance with the patent law, including the doctrine of equivalents.

We claim:

1. A passive exercise apparatus for use by a human being in an erect, non-recumbent seating position, the apparatus comprising:

a seating element having forward and rearward ends, lateral ends, an upper surface capable of supporting said human being, and a lower surface, said seating element comprising a lumbar support channel disposed toward said rearward end, lateral support channels disposed toward said lateral ends and in connection with said lumbar support channel, defining a U-shape, and a plurality of cells disposed therewithin;

means for providing omni-directional movement attached to said lower surface such that when a user is seated on said seating element, said means for providing omni-directional movement results in said seating element rocking involuntarily such that muscular contraction, in the form of the combined execution of concentric and isometric muscle exertion and contractions performed while sitting on said apparatus to restore a user to an erect and stable seating position; and a base support element arranged such that said means for providing omni-directional movement is disposed between said seating element and said base support element;

wherein said base support element comprises a lower base member, an upper base member and a flexible biasing means therebetween for attaching said upper base member to said lower base member.

2. The exercise apparatus of claim 1, wherein said means for providing omni-directional movement has a geometry selected from the group consisting of hemispherical, modified frustoconical, or cylindrical.

3. The exercise apparatus of claim 2, wherein said hemispherical geometry is substantially defined by an arrayed series of semi-circular planar fins.

4. The exercise apparatus of claim 1, wherein said lumbar support channel, said lateral support channels, and said plurality of cells are in fluid communication and are each capable of accommodating a material selected from the group consisting of compressible materials and resilient materials.

5. The exercise apparatus of claim 4, wherein said material is selected from the group consisting of air, liquids, gels, and foams.

6. The exercise apparatus of claim 5, wherein said air may be introduced into said seating element and expelled therefrom by means of at least one valve.

7. The exercise apparatus of claim 1, wherein said air may be introduced into said seating element and expelled therefrom by air moving means in fluid communication with said at least one valve.

8. The exercise apparatus of claim 1, wherein said plurality of cells are in the form of longitudinal channels.

9. The exercise apparatus of claim 8, wherein said plurality of cells are connected to said lumbar support channel, said lateral support channels, and each other such that they may each move independently.

10. The exercise apparatus of claim 1, wherein said lumbar support channel, said lateral support channels, and said plurality of cells are each capable of accommodating therewithin a plurality of motion drivers.

11. The exercise apparatus of claim 10, wherein said motion drivers each has a geometry selected from the group consisting of spherical, ellipsoid, cylindrical, and geodesic.

12. The exercise apparatus of claim 11, wherein said motion drivers each is capable of accommodating about its surface a plurality of surface features selected from the group consisting of dimples, grooves, and radial projections.

13. The exercise apparatus of claim 1, wherein said seating element is further attached to a support base element that provides a planar surface in contact with said means for providing omni-directional movement, such that said involuntary rocking is enabled.

14. The exercise apparatus of claim 1, wherein said means for providing omni-directional movement is hemispherical in cross-section.

15. The exercise apparatus of claim 1, wherein said means for providing omni-directional movement is frustoconical in cross-section.

16. The exercise apparatus of claim 1, wherein said base support element is attached to said seating element by attachment means that permit sufficient relative motion therebetween to achieve the desired omni-directional rocking motion.

17. The exercise apparatus of claim 1, wherein said lower base member is disposed partly within said upper base member such that only a predefined travel distance of each member relative to the other is possible.

18. A passive exercise apparatus comprising:

means for supporting a human being in an erect, non-recumbent seating position;

means for providing omni-directional movement attached to said lower surface such that when a user is seated on said seating element, said means for providing omni-directional movement enables said seating element to rock involuntarily such that muscular contraction, in the form of the combined execution of concentric and isometric muscle exertion and contractions performed while sitting on said apparatus to restore a user to an erect and stable seating position and a base support element arranged such that said means for providing omni-directional movement is disposed between said seating element and said base support element;

wherein said base support element comprises a lower base member, an upper base member and a flexible biasing means therebetween for attaching said upper base member to said lower base member.

19. An exercise apparatus comprising a seat having an upper seating surface and defining therein at least one chamber; and a plurality of motion drivers movable within the chamber, the motion drivers comprising substantially solid, discrete elements for promoting localized stimulation to a user seated upon the upper seating surface;

wherein the motion drivers comprises a substantially resilient material.

20. The exercise apparatus of claim 19 wherein the seat further comprises an inner layer and a lower surface, wherein the inner layer and the lower surface define a plurality of discrete chambers.

21. The apparatus of claim 19 wherein the seat further comprises an inner layer and a lower surface wherein the inner layer and the lower surface define a plurality of inner channels and the motion drivers are disposed within at least one of the inner channels.

22. The apparatus of claim 21 wherein the inner channels comprise substantially parallel longitudinal tubes.

23. The apparatus of claim 22 wherein adjacent inner channels are substantially attached along the longitudinal length.

24. The apparatus of claim 23 wherein adjacent inner channels are attached along the longitudinal length by an interstitial web extending between adjacent inner channels.

25. The exercise apparatus of claim 19, further comprising a top chamber defined by the upper seating surface and the inner layer.

26. The exercise apparatus of claim 19, further comprising a lumbar support channel disposed along a rearward end of the seat;

a first lateral support channel disposed along a first end of the seat; and a second lateral support channel disposed along a second end of the seat.

27. The exercise apparatus of claim 26 wherein the lumbar support channel, the first lateral support channel, and the second lateral support channel are in fluid communication.

28. The exercise apparatus of claim 21 wherein the inner channels comprise user-removable ends releasably attached thereto for modifying the number of motion drivers disposed therein.

29. The exercise apparatus of claim 21 wherein the motion drivers are further disposed within the lumbar support channel, the first lateral support channel, and the second lateral support channel.

30. The exercise apparatus of claim 19 wherein the motion drivers comprises an elastomer.

31. The exercise apparatus of claim 21 wherein the motion drivers are constructed and arranged to move freely about the lumbar support channel, the first lateral support channel, and the second lateral support channel.

32. The exercise apparatus of claim 21 wherein at least one of inner channels is inflated with a fluid.

33. The exercise apparatus of claim 21 wherein at least one of the inner channels is filled with a material selected from the group consisting of colloid, gel, and foam.

34. The exercise apparatus of claim 19, further comprising a valve for introducing and/or expelling a gas or liquid into the inner channels.

35. The apparatus of claim 19 wherein the seat comprises polyvinyl chloride.

36. The apparatus of claim 19 wherein the seat comprises polyurethane.

37. The apparatus of claim 19 wherein a fabric laminate is bonded to the upper seating surface.

38. The exercise apparatus of claim 21 wherein the lumbar support channel comprises a material with a substantially high thermal conductivity, and the lumbar support channel (30) is releasably attached to the seat.

39. The exercise apparatus of claim 21 further comprising an external pump means and a pump means controller, the pump means being in fluid communication with the plurality of inner channels.

40. An exercise apparatus comprising a seat having an upper seating surface and defining therein a plurality of woven channels; and at least one motion driver disposed within the woven channels for providing localized pressures concentrations to the user; wherein the motion driver is movable within the channels, and the motion drivers comprise solid, discrete elements that provide localized pressure concentration for causing a user seated upon the seating surface to shift weight in response to the pressure concentration.

41. The exercise apparatus of claim 40 wherein the woven channels further comprise first channels extending in a first direction and second channels extending in a second direction, the second direction being normal to the first direction, wherein the first channels comprise motion drivers and the second channels comprise a fluid.

42. The exercise apparatus of claim 40 wherein the first channels and the second channels comprise a fluid.

43. The exercise apparatus of claim 41, further comprising an external pump means and a pump controller, the pump means being in fluid communication with the woven channels.

44. The exercise apparatus of the claim 43 wherein the pump controller is adapted to inflate and deflate the woven channels according to a predetermined sequence.

45. A method for stimulating a seated user, the method including providing a seat having an upper seating surface and defining therein a plurality of woven channels, and at least one motion driver disposed within the woven channels for providing localized stimulation to the user, wherein the motion driver is movable within the channels, and the motion drivers comprise solid, discrete elements that provide localized pressure concentration for causing a user seated upon the seating surface to shift weight in response to the pressure concentration;

inflating at least one of the plurality of individual channels; and deflating at least one of the plurality of individual channels.

46. The method of claim 45 wherein the inflating and deflating steps are performed mechanically and/or electrically according to a predetermined sequence.

* * * * *